US009784050B2

(12) United States Patent
Smith et al.

(10) Patent No.: US 9,784,050 B2
(45) Date of Patent: Oct. 10, 2017

(54) TRANSFER SLEEVE FOR COMPLETIONS LANDING SYSTEMS

(71) Applicant: Frank's International, LLC, Houston, TX (US)

(72) Inventors: Logan E. Smith, Youngsville, LA (US); Jeremy R. Angelle, Youngsville, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 0 days.

(21) Appl. No.: 15/461,746

(22) Filed: Mar. 17, 2017

(65) Prior Publication Data

US 2017/0191322 A1 Jul. 6, 2017

Related U.S. Application Data

(62) Division of application No. 14/184,956, filed on Feb. 20, 2014, now Pat. No. 9,630,811.

(51) Int. Cl.
*B66B 1/42* (2006.01)
*E21B 19/00* (2006.01)
(Continued)

(52) U.S. Cl.
CPC ..... *E21B 19/00* (2013.01); *B66C 1/44* (2013.01); *E21B 19/06* (2013.01)

(58) Field of Classification Search
CPC ... B66C 1/44; B66C 1/46; E21B 19/06; E21B 19/10; E21B 33/0422; E21B 19/07; E21B 19/14; E21B 19/00
See application file for complete search history.

(56) References Cited

U.S. PATENT DOCUMENTS 1,674,144 A 6/1928 Traves
6,644,413 B2 11/2003 Adams et al.
(Continued)

FOREIGN PATENT DOCUMENTS

WO 2005003504 A2 1/2005
WO 2012121934 A2 9/2012

OTHER PUBLICATIONS

Jong Kyung Lee (Authorized Officer), International Search Report and Written Opinion dated May 22, 2015, International Application No. PCT/US2012/015642, filed Feb. 12, 2015, pp. 1-16.
(Continued)

*Primary Examiner* — Stephan A Vu
(74) *Attorney, Agent, or Firm* — MH2 Technology Law Group LLP

(57) ABSTRACT

A tubular handling system and method for handling tubulars are provided. The tubular handling system includes a load transfer sleeve. The load transfer sleeve includes a body defining an inner diameter and a tapered bowl extending outward from the inner diameter, with the bowl defining a landing surface. The load transfer sleeve also includes a load bushing comprising a plurality of load bushing segments that are slidable along the bowl. The load bushing radially expands and contracts by axial translation of the plurality of load bushing segments relative to the body. Further, the plurality of load bushing segments each define an axial engagement surface configured to engage an upset of a tubular and a landing surface that engages the landing surface of the bowl when the axial engagement surface engages the upset.

20 Claims, 6 Drawing Sheets

(51) Int. Cl.
*B66C 1/44* (2006.01)
*E21B 19/06* (2006.01)

(56) References Cited

U.S. PATENT DOCUMENTS

| | | | |
|---|---|---|---|
| 6,920,931 | B1 | 7/2005 | Webre et al. |
| 7,143,849 | B2 | 12/2006 | Shahin |
| 7,337,853 | B2 | 3/2008 | Buytaert et al. |
| 7,681,649 | B2 | 3/2010 | Cerovsek |
| 7,992,634 | B2 | 8/2011 | Angelle |
| 7,997,333 | B2 | 8/2011 | Angelle |
| 8,082,997 | B2 | 12/2011 | Webre et al. |
| 8,096,540 | B2 | 1/2012 | Claxton |
| 2002/0096337 | A1 | 7/2002 | Bouligny et al. |
| 2004/0182611 | A1 | 9/2004 | Ramey et al. |
| 2007/0261857 | A1 | 11/2007 | Kuttel et al. |
| 2010/0059231 | A1 | 3/2010 | Thomas et al. |

OTHER PUBLICATIONS

Mallenahalli et al., "Kizomba, New Levels of Deepwater Performance for a Unique Development Off Angola", Frank's International Direct, vol. 3, Issue 1, 1st Quarter 2005, Oil & Gas Industry, pp. 1-32.

TRANSFER SLEEVE FOR COMPLETIONS LANDING SYSTEMS

STATEMENT OF RELATED APPLICATIONS

This application is a divisional of U.S. patent application Ser. No. 14/184,956 filed on Feb. 20, 2014, which has been issued as U.S. Pat. No. 9,630,811, dated Apr. 25, 2017, the entirety of which is incorporated herein by reference.

BACKGROUND

In oilfield operations, tubulars such as drill pipe and casing are run into a wellbore. The tubulars are generally run into the wellbore as "stands." Each stand includes several, for example, three lengths or "joints" of the tubulars made up together, end-on-end. The stand is made up to the tubular string already deployed, and lowered into the wellbore for attachment to the next stand. Running in of multiple joints at once as part of the stand reduces the amount of time taken to connect the joints together, since there are fewer joints that must be made up during run-in or disassembled during removal of the tubulars from the wellbore.

Prior to deploying the stands, or after they are removed from the wellbore, the stands may be stored in a vertical orientation in a pipe rack. The process of storing the stands in the pipe rack may be known as "racking back" the stand. Each stand can be run into the wellbore, removed from the wellbore ("tripped out"), and racked back multiple times, so long as the stands are not excessively damaged during use.

Load transfer sleeves are sometimes employed to provide a connection with the stands. Such load transfer sleeves can be a designed to be received around a tubular and bear against an upset along the stand. Upsets are generally provided by a collar, a lift nubbin, or an increased diameter area where the box-end connection is formed. In other cases, the load transfer sleeve may include slips that bite into the tubulars. In either case, the stand may be hoisted, e.g., via a spreader bar or an elevator coupled with the load transfer sleeve.

In various applications, slips may be avoided for use with the load transfer sleeves. The radial gripping force applied by the slips is proportional to the weight of the tubular being supported. However, the tubular gripped by the slips may be part of a stand that is made up to a string of tubulars already run into the wellbore. Once made up, the entire weight of the string may be applied to the slips, which can result in the slips applying an excessive gripping force on the tubular, which can damage the tubular.

The load transfer sleeves that bear on an upset, however, may be specific to the size of the tubular and/or the size of the upset upon which they bear. Further, such load transfer sleeves may require manual handling, e.g., to receive a hinged transfer sleeve around the tubular and latch it below the upset. Thus, in some cases, attaching the load transfer sleeve to the tubular stand may be required to be done while the load transfer sleeve is in a horizontal configuration, which may require further manipulation of the stand when the stand is already racked back in a vertical orientation.

SUMMARY

Embodiments of the present disclosure may provide a load transfer sleeve. The load transfer sleeve includes a body defining an inner diameter and a tapered bowl extending outward from the inner diameter, with the bowl defining a landing surface. The load transfer sleeve also includes a load bushing comprising a plurality of load bushing segments that are slidable along the bowl. The load bushing radially expands and contracts by axial translation of the plurality of load bushing segments relative to the body. Further, the plurality of load bushing segments each define an axial engagement surface configured to engage an upset of a tubular and a landing surface that engages the landing surface of the bowl when the axial engagement surface engages the upset.

Embodiments of the disclosure may also provide a method for handling a tubular. The method includes positioning a load transfer sleeve around the tubular, adjacent to an upset of the tubular. The method also includes contracting a radially-expandable load bushing of the load transfer sleeve, such that a plurality of load bushing segments of the radially-expandable load bushing abut a landing surface of a bowl defined in a body of the load transfer sleeve. The method further includes moving the radially-expandable load bushing relative to the tubular, after contracting the radially-expandable load bushing, until the upset of the tubular abuts an axial engagement surface of the radially-expandable load bushing. The method additionally includes lifting the tubular by lifting the load transfer sleeve.

Embodiments of the disclosure may further provide a tubular handling system. The tubular handling system includes a load transfer sleeve. The load transfer sleeve includes a body defining an inner diameter and a tapered bowl extending outward from the inner diameter, with the bowl defining a landing surface. The load transfer sleeve also includes a load bushing including a plurality of load bushing segments that are slidable along the bowl so as to radially expand and contract the load bushing by axial translation of the plurality of load bushing segments relative to the body. The plurality of load bushing segments each define an axial engagement surface configured to engage an upset of a tubular and a landing surface that engages the landing surface of the bowl when the axial engagement surface engages the upset. The plurality of load bushing segments are configured to transfer a weight of the tubular from the upset to the body via the engagement between the landing surface of the bowl and the landing surface of the plurality of load bushing segments. The tubular handling system also includes a lifting device configured to engage the body of the load transfer sleeve and lift the tubular by lifting the load transfer sleeve, and a spear configured to be received at least partially into the elevator and to support the load transfer sleeve when the lifting device is removed.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate an embodiment of the present teachings and together with the description, serve to explain the principles of the present teachings. In the figures.

Figure 3:
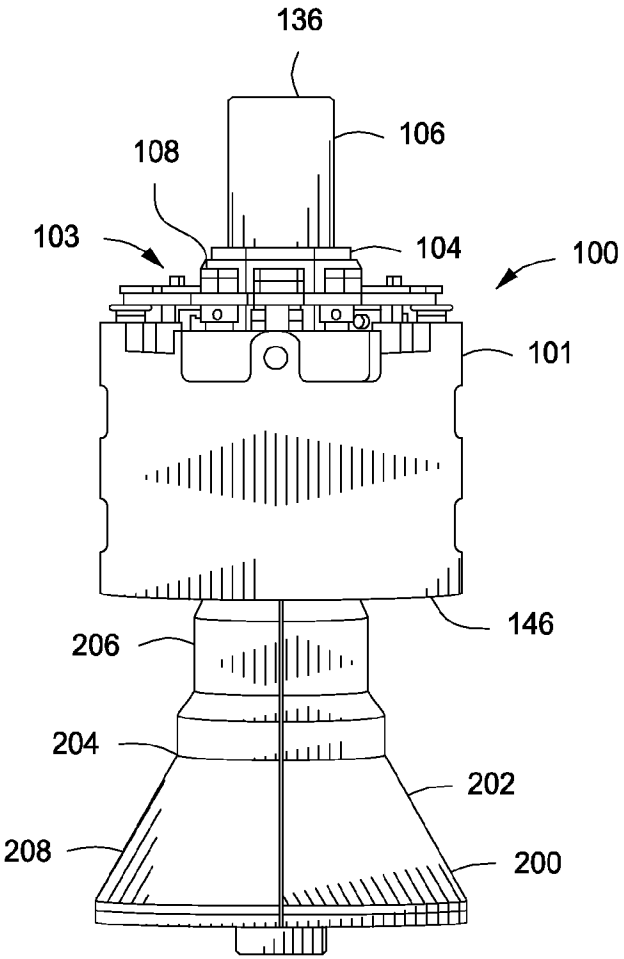
FIG. 3 illustrates a side perspective view of the load transfer sleeve set onto a spear, according to an embodiment.

It should be noted that some details of the figures have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

Figure 1:
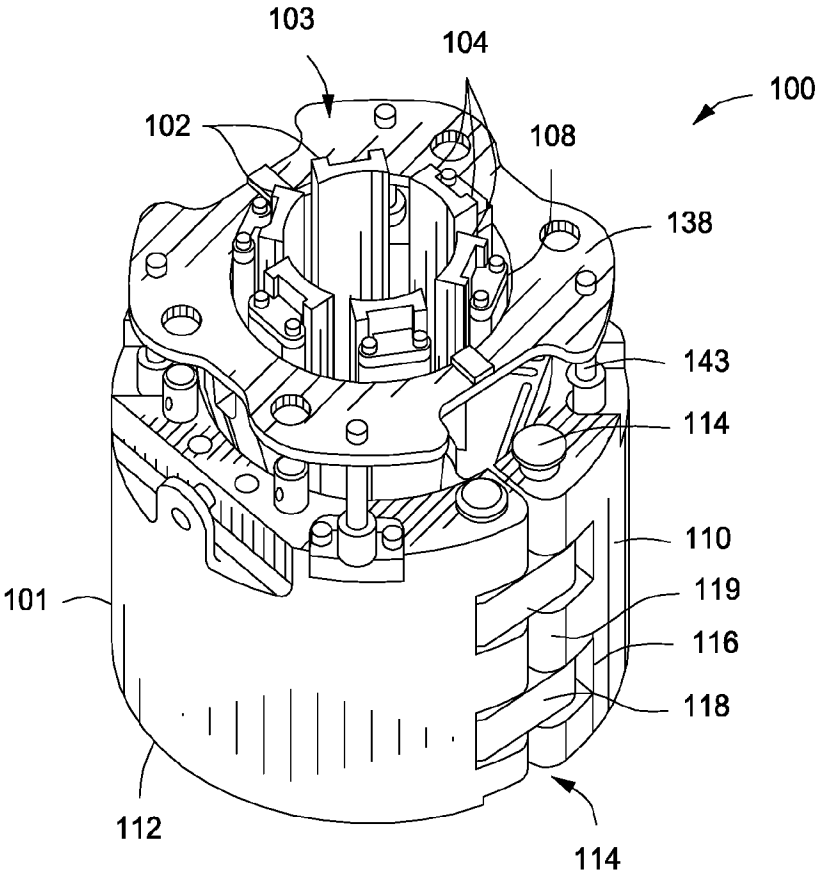
FIG. 1 illustrates a raised perspective view of a load transfer sleeve, according to an embodiment.
Figure 2:
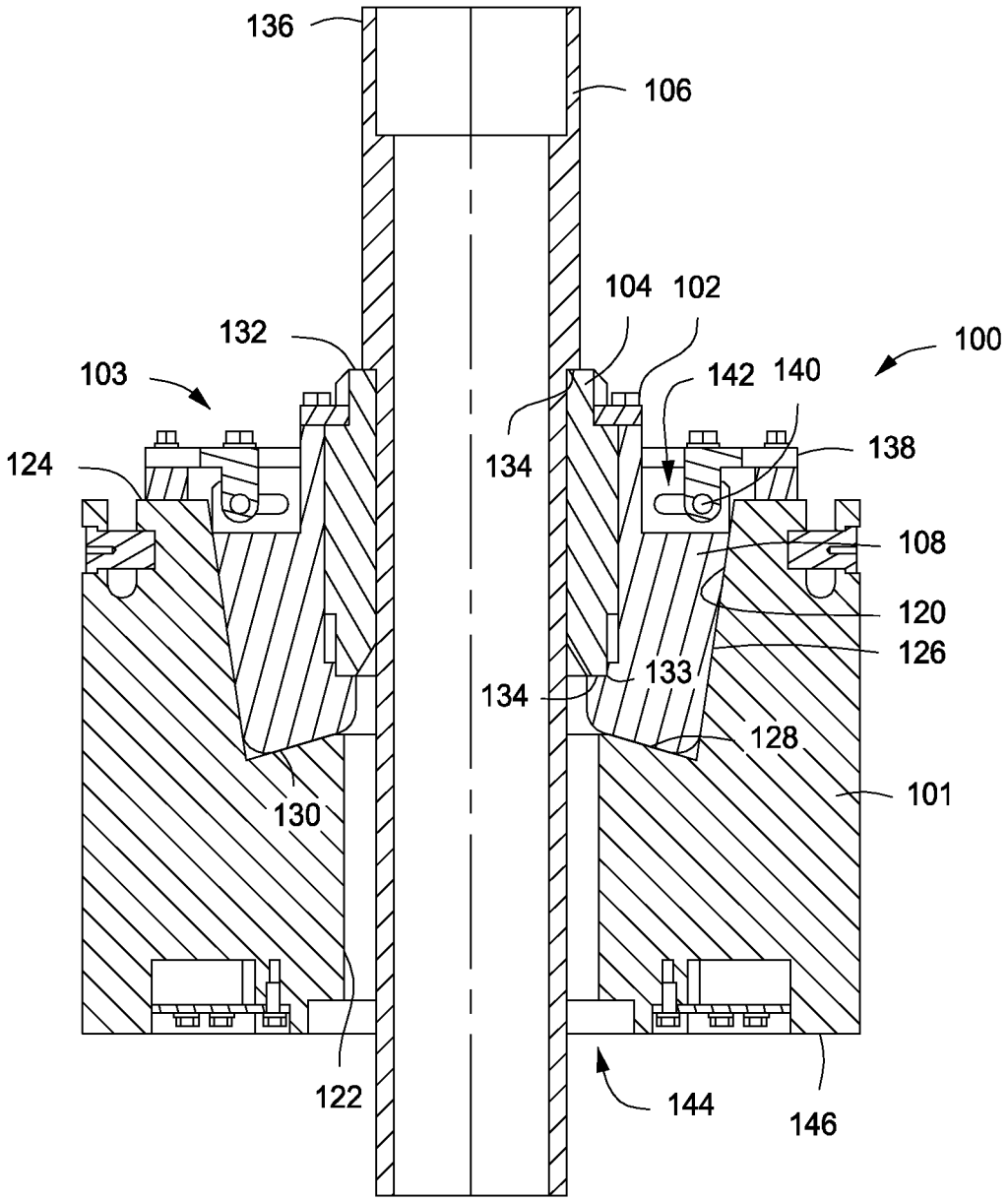
FIG. 2 illustrates a side, cross-sectional view of the load transfer sleeve, according to an embodiment.

FIGS. 1 and 2 illustrate a perspective view and a cross-sectional view, respectively, of a load transfer sleeve 100, according to an embodiment. In some instances, the load transfer sleeve 100 may be configured for use as part of a completions landing system; however, in other embodiments, the load transfer sleeve 100 may be configured for any other use.

In the illustrated embodiment, the load transfer sleeve 100 generally includes a body 101 and a radially-expandable load bushing 103. The load bushing 103 includes a plurality of load bushing segments 102, which may be disposed at least partially inside the body 101. One, some, or all of the bushing segments 102 may include an insert 104 that may be configured to engage a tubular 106 (FIG. 2). Further, the bushing segments 102 may each include a carrier 108 that is coupled with the insert 104 of each bushing segment 102, such that the insert 104 is radially between the carrier 108 and the tubular 106, when the tubular 106 is present. The inserts 104 may be selected from a kit of inserts of varying thickness, height, shape, material, or other characteristics, e.g., according to the size, material, etc. of the tubular 106 with which they are to be employed. Further, the inner diameter of the inserts 104 may be non-marking.

Each of the inserts 104 may define an axial engagement surface 132. The axial engagement surface 132 may, in some embodiments, be disposed at or proximal to the top of the insert 104; however, embodiments in which the axial engagement surface 132 is below the top of the insert 104 are contemplated. The axial engagement surface 132 may be shaped to engage with an upset 134 of the tubular 106. In an example, the upset 134 may be formed at a box end 136 of the tubular 106. In another embodiment, the upset 134 may be a shoulder provided by a lift nubbin threaded into the box end 136, e.g., in a flush pipe (no integral upset) configuration of the tubular 106. In still other embodiments, the upset 134 may be any other radially outward projection from the tubular 106 that is coupled therewith as to at least support the weight thereof.

The inserts 104 may also include a lower landing surface 131 that mates with an upper landing surface 133 of each of the carriers 108. The engagement between the lower landing surface 131 and the upper landing surface 133 may allow an axial load carried by the insert 104 (e.g., from the weight of the tubular 106) to be transferred from the insert 104 to the carrier 108. Further, each carrier 108 may also include a landing surface 130 proximal or at the axial bottom thereof. The landing surface 130 may be inclined to radial, for example, extending toward the top of the carrier 108 as proceeding radially inward.

Turning now to the body 101, the body 101 may be segmented into two or more body portions 110, 112, which may be coupled together via a hinge 114 and a latch (not visible). In such configuration, the body 101 may thus provide a door that, when opened, allows the load transfer sleeve 100 to be positioned around or removed laterally from around the tubular 106. In at least one embodiment, the hinge 114 may include one or more pins 116 received through one or more links 118 and/or one or more knuckles 119 of the body portions 110, 112. In other embodiments, however, the body 101 may be unitary or segmented into three or more portions. Further, the body portions 110, 112 may be coupled together in any manner suitable, with the use of pins 116, etc., being merely one example among many contemplated.

Referring specifically to FIG. 2, the body 101 may define a bowl 120 along at least a portion of an inner diameter 122 thereof. The bowl 120 may extend from, for example, a top 124 of the body 101. Proceeding from the top 124, the bowl 120 may have a reducing diameter, i.e., may define a truncated conical (frustoconical) shape. A radially outer surface 126 of each of the carriers 108 may have a complementary shape to the bowl 120, such that the carriers 108 slide against the bowl 120 when the carriers 108 are moved relative to the body 101. In at least one example, the carriers 108 may be biased outwards into contact with the bowl 120.

Further, the bowl 120 may define a landing surface 128 at the axial extent of the bowl 120, opposite to the top 124. The landing surface 128 may be inclined such that it extends toward the top 124 as proceeding radially inward, which may be considered a reverse taper. For example, the landing surface 128 may be tapered so as to mate with the landing surfaces 130 of the carriers 108. That landing surfaces 130 of the carriers 108 may abut the landing surface 128 of the bowl 120, such that further axial and radial movement of the carriers 108 relative to the body 101 may be prevented. Such landing surface engagement may prevent radially-inwardly directed gripping forces applied to the tubular 106 by the load bushing segments 102. It will be appreciated that in some cases, the landing surfaces 128, 130 may not be inclined and/or may abut along a portion of their respective surfaces.

Accordingly, when fully set down, the axial engagement surfaces 132 of the inserts 104 of the load bushing segments 102 may engage the upset 134, so as to support the weight of the tubular 106. The weight of the tubular 106 may be transmitted from the insert 104 to the carrier 108 via the engagement between the lower landing surface 131 and the upper landing surface 133. The load may then be transferred to the body 101 via the engagement between the lower landing surface 130 of the carrier 108 and the landing surface 128 of the bowl 120. This system of landing surfaces 128-133 may thus transmit the axial load from the tubular 106 to the body 101, while preventing the load bushing segments 102 from applying a radial gripping force on the tubular 106.

Further, the load bushing segments 102 may be coupled together using a setting plate 138. In at least one embodiment, the load bushing segments 102 may be pivotably coupled to the setting plate 138 via one or more pins 140 disposed in slots 142 defined in the carriers 108. The pins 140 may slide in the slots 142, so as to allow the bushing segments 102 to slide radially when moved axially. To effect such axial movement, the setting plate 138 may be driven up and down, relative to the body 101, for example, via one or more actuators 143. The actuators 143 may each include one or more hydraulic cylinders, pneumatic cylinders, mechanical devices, combinations thereof, or the like. Accordingly, by extension or retraction of the actuators 143, the load bushing segments 102 may be lifted out of the bowl 120 or pushed downward into the bowl 120. In some embodiments, however, the load bushing segments 102 may be disposed within the bowl 120 at all times. For example, the axial extent of the bowl 120 may be larger than the load bushing segments 102.

During movement of the load bushing segments 102 with respect to the body 101, the load bushing segments 102 may slide against the bowl 120. Accordingly, the axial movement of the setting plate 138 results in both an axial and a radial movement of the load bushing segments 102, as defined by the inclination of the bowl 120 with respect to a longitudinal axis of the body 101.

As shown in FIG. 2, the body 101 may also define a groove 144 therein. In an example, the groove 144 may extend upwards from a bottom 146 of the body 101 and outwards from the inner diameter 122. Further, in at least one embodiment, the groove 144 may be square in cross-section, as shown, which may correspond to a disk-shape. However, in other embodiments, the groove 144 may be tapered, conical, or a more complex geometry of one or more shoulder, steps, shapes, etc. For example, the groove 144 may be shaped to receive a spear.

FIG. 3 illustrates a side perspective view of an example of the load transfer sleeve 100 with such a spear 200. The spear 200 may be segmented into two or more arcuate portions 202, 204. Further, the arcuate portions 202, 204 maybe relatively pivotable with respect to one another. For example, as shown in FIG. 2, the arcuate portion 202 may pivot clockwise, while the arcuate portion 204 may pivot counterclockwise, so as to open around the tubular 106. Additionally, the spear 200 may be disposed on a shock table, which may be coupled with the platform through which an opening leading to the wellbore is defined.

The spear 200 may define an upper-most portion, which is configured to be received into the groove 144. The upper-most portion may be generally cylindrical, so as to fit with the disk-shaped groove 144, according to an embodiment. In other embodiments, the upper-most portion may be any other shape, e.g., according to the shape of the groove 144. The spear 200 may also include an elevator-receiving portion 206 and a base 208, with the elevator-receiving portion 206 being above the base 208. The base 208 may rest on the shock table.

Figure 4:
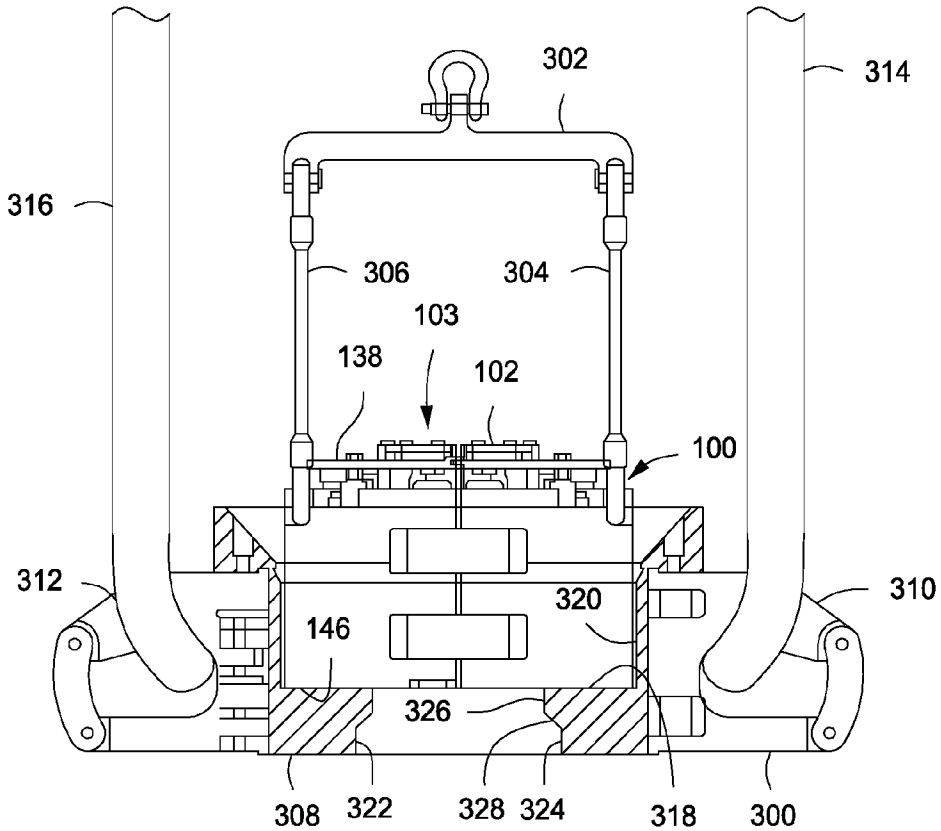
FIG. 4 illustrates a side sectional view of the load transfer sleeve coupled with an elevator and a spreader bar, according to an embodiment.

Referring now to FIG. 4, there is shown a side view of the load transfer sleeve 100 received into an elevator 300, with the elevator 300 being shown partially in section, according to an embodiment. Further, a spreader bar 302 may be coupled with the load transfer sleeve 100 via lines 304, 306. The elevator 300 may include an elevator body 308 that is coupled with ears 310, 312. The ears 310, 312 may be configured to engage bails 314, 316, respectively, which may be configure to hoist the elevator 300, e.g., using a travelling block or any other rig component. The elevator 300 may have a door, i.e., a portion of the elevator body 308 may be pivotable relative to the rest of the elevator body 308, so as to allow the tubular 106 (FIGS. 2 and 3) and the load transfer sleeve 100 to be received laterally therein. In some cases, the elevator 300 may receive the tubular 106 below the load transfer sleeve 100, and then may be raised relative to the tubular 106 and the load transfer sleeve 100, so as to receive the load transfer sleeve 100 through the top of the elevator 300, after receiving the tubular 106 into the elevator 300 below the load transfer sleeve 100

The elevator 300 may further define a landing surface 318 that is sized to receive the bottom 146 of the body 101 of the load transfer sleeve 100. The elevator 300 may also define an inner diameter 320 above the landing surface 318 that is sized to receive the circumference of the load transfer sleeve 100. In some cases, the inner diameter 320 may snugly receive the load transfer sleeve 100, while in others, it may allow for some radial movement with respect thereto, prior to the load of the stand being transmitted to the elevator 300 via the load transfer sleeve 100.

The elevator 300 may also define a profiled lower inner diameter 322 below the landing surface 318. The profiled lower inner diameter 322 may be shaped to engage the elevator-receiving portion 206 of the spear 200 (FIG. 3) when the load transfer sleeve 100 is set down on the spear 200. For example, the lower inner diameter 322 may define a first diameter section 324, a second diameter section 326 that is larger than the first diameter section 324, and a conical surface 328 extending therebetween. This may correspond to the shape of the elevator-receiving portion 206 of the spear 200. In other embodiments, the lower inner diameter 322 may have any other profile, shape, etc.

Figure 5:
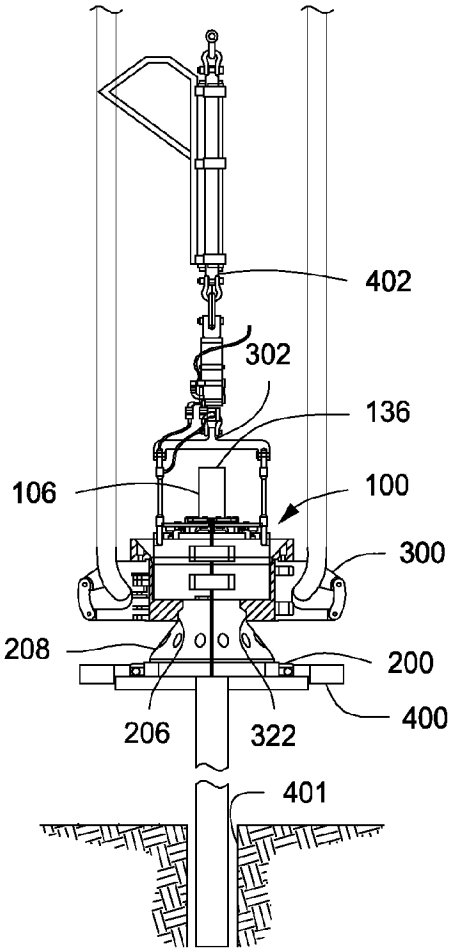
FIG. 5 illustrates a side sectional view of the load transfer sleeve coupled with the elevator and the spreader bar and set onto the spear, according to an embodiment.

FIG. 5 illustrates a side view of the load transfer sleeve 100 received into the elevator 300, again shown in partial section, and set onto the spear 200, according to an embodiment. As shown, the elevator-receiving portion 206 of the spear 200 is received into the lower, profiled inner diameter 322 of the elevator 300. When the shapes of the elevator-receiving portion 206 and the profiled, lower inner diameter 322 are complementary, the spear 200 may be allowed to slide into the elevator 300, but may prevent excessive lateral movement of the elevator 300 with respect thereto, or at least take up some of the lateral forces that otherwise would be applied to the tubular 106 by the elevator 300. Further, as shown, the tubular 106 may be received though the spear 200, with the spear 200 being supported by a shock table 400. The tubular 106 may proceed downward through the spear 200, for example, as part of (i.e., made up to) a larger string of tubulars received into a wellbore 401.

In some cases, the load transfer sleeve 100 may be configured to be set down directly on the shock table 400 or another platform. For example, the load transfer sleeve 100 may include a downward extension or bushing that is received into the top of the wellbore 401, so as to prevent or minimize lateral movement of the load transfer sleeve 100. In other embodiments, other structures may be employed to stabilize the load transfer sleeve 100. As such, it will be appreciated that the spear 200, groove 144, and/or the lower, profiled inner diameter 322 may be omitted in at least some embodiments.

Further, the spreader bar 302 may be coupled with a compensator 402. The compensator 402 may be employed to assist in stabbing the tubular 106 into a subjacent tubular (i.e., a tubular that has been previously run into the wellbore). The compensator 402 may support the weight of the tubular 106 prior to and/or during make-up to a subjacent tubular, such that the spreader bar 302 may gently lower the tubular 106 into a mating connection with the subjacent tubular. Accordingly, the compensator 402 may avoid collisions and/or ensure that a minimal axial load is applied when making up the pin end of the tubular 106 to the box end of the subjacent tubular, so as to protect the threads from damage. In at least one example, the compensator 402 may be a Backpacker™ commercially available from Frank's International.

FIGS. 6-9 illustrate quarter sectional views of the load transfer sleeve 100, depicting a sequence of operation, according to an embodiment. The load transfer sleeve 100 may be employed regardless of the starting orientation of the tubular 106. That is, the tubular 106 may begin in a horizontal orientation, a vertical or "racked back" orientation, or at any angle in between. For example, in a vertical tubular 106 start, the transfer sleeve 100 may be lowered down over the box end 136 of the tubular 106 by lowering the elevator 300 or the spreader bar 302, or both, so as to lower the transfer sleeve 100 therewith.

Figure 7:
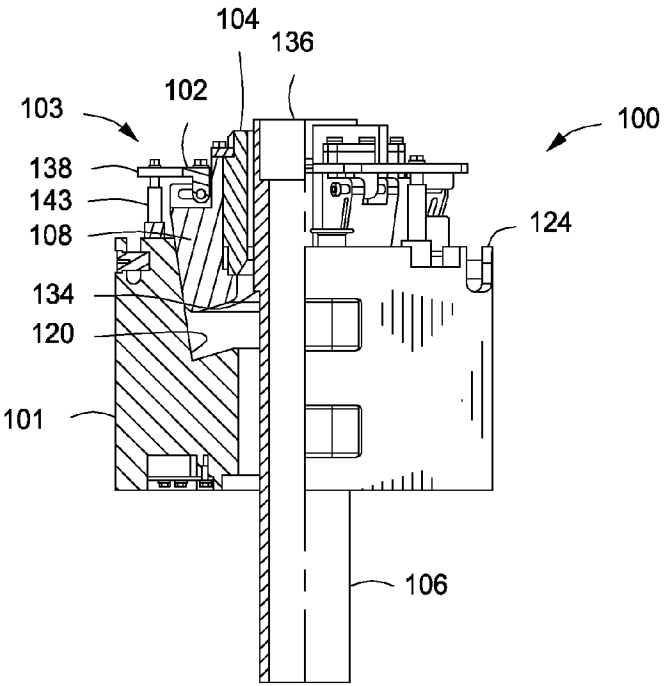
FIGS. 6-9 illustrate quarter sectional views of the load transfer sleeve at various points of an example of operation, according to an embodiment.
Figure 6:
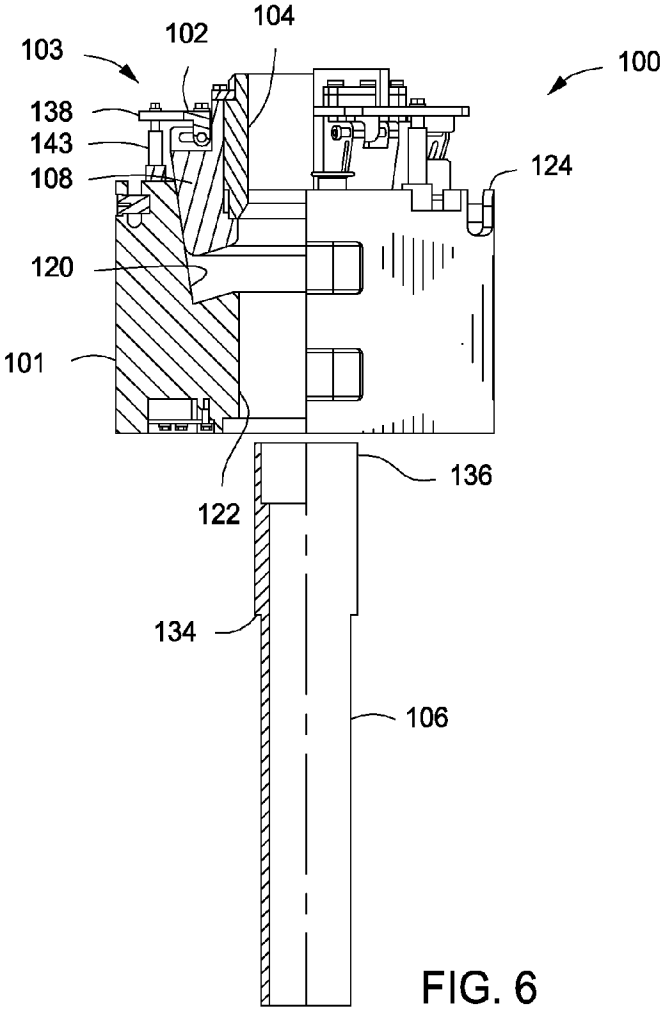
Figure 8:
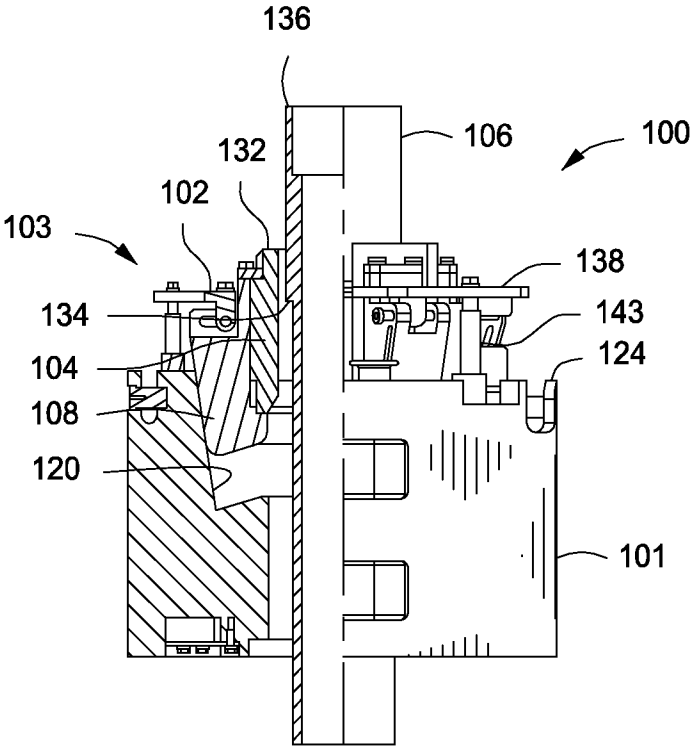

In particular, as shown in FIG. 6, the setting plate 138 may be moved away from the body 101 by extending the actuators 143. The load bushing segments 102 may follow the setting plate 138 to which they are attached and may thus move up in (and/or at least partially out of) the bowl 120. The load bushing segments 102 moving upwards with respect to the tapered bowl 120 may result in the load bushing segments 102 being radially displaced outwards, i.e., along the taper of the bowl 120. As such, the radial inside of the insert 104 may be moved radially outward, and thus the load bushing 103 may be radially expanded. With the load bushing 103 expanded, the box end 136 of the tubular 106 may slide through the inner diameter 122 and past the inserts 104, as shown in FIG. 7. The load transfer sleeve 100 may continue advancing downwards relative to the tubular 106, for example, until the upset 134 is near or above the top of the insert 104, as shown in FIG. 8. In some cases, the tubular 106 may be moved farther up, without limitation.

Figure 9:
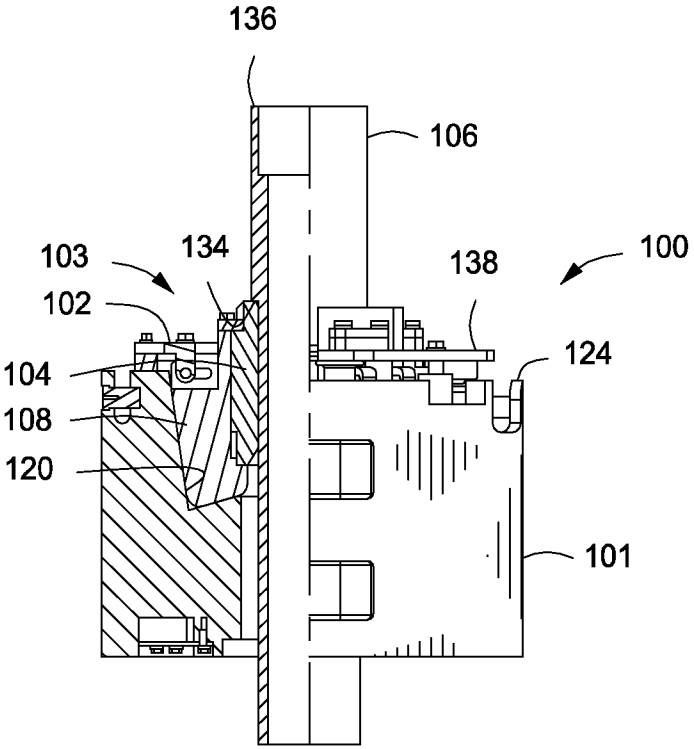

Referring now to FIG. 9, the actuators 143 (FIG. 6) may be retracted, and the setting plate 138 lowered back toward the top 124 of the body 101. As such, the load bushing segments 102 may slide downwards in the bowl 120. The load bushing segments 102 sliding along the tapered bowl 120 may cause the load bushing segments 102 to move radially inward until the landing surfaces 128, 130 are abutting. The abutting of the landing surfaces 128, 130 may prevent further movement of the load bushing segments 102 axially or radially. Further, the bowl 120 and the load bushing segments 102 may be configured such that, when the carriers 108 land on the landing surface 128 of the bowl 120, the inserts 104 may apply minimal or no radially inwardly directed force on the tubular 106. Accordingly, in some cases, the tubular 106 may remain slidable with respect to the load transfer sleeve 100, at least initially. In some cases, a pin or another device may be employed to restrain the setting plate 138 in a position proximal to the body 101.

The load transfer sleeve 100 may then be slid upwards (e.g., via the spreader bar 302 and/or elevator 300) relative to the tubular 106 until the axial engagement surface 132 of the insert 104 abuts the upset 134 of the tubular 106. The load transfer sleeve 100 may then transfer the weight of the tubular 106 to the body 101 via the axial engagement surface 132 and the landing surfaces 128-133, as noted above.

Accordingly, with the load transfer sleeve 100 being coupled with the spreader bar 302, the load transfer sleeve 100 may thus serve to transfer the weight of the tubular 106 to the spreader bar 302. The spreader bar 302 may then be lowered, so as to stab the pin end of the tubular 106 into a box end of a subjacent tubular. The tubular 106 may then be made up (threaded to) the subjacent tubular, e.g., via tongs or other rotational devices.

Once the tubular 106 is made up to the tubular string, the elevator 300 may engage the transfer sleeve 100, in preparation for supporting the weight of the string. With the elevator 300 engaged, the spear 200 may disengage from the tubular string, and the elevator 300 may be lowered so as to deploy the tubular 106 into the wellbore.

As the elevator 300 is lowered, the load transfer sleeve 100 may eventually receive the spear 200 (FIGS. 3 and 5), in preparation for the spear 200 supporting the weight of the tubular string. The elevator 300 may then be disengaged from the load transfer sleeve 100, leaving the engagement between the spear 200 and the load transfer sleeve 100 supporting the tubular string, until the next tubular (e.g., stand) is made up to the box end 136 of the tubular 106. When the next tubular is made up to the tubular 106, the load transfer sleeve 100 may be removed laterally from the tubular 106, for example, via the hinge 114 (FIG. 1) and latch assembly connecting the two arcuate body portions 110, 112.

Accordingly, the load transfer sleeve 100 may support the weight of the tubular 106 and, e.g., the weight of an entire tubular string, by transferring the weight from the upset 134 to the body 101 via the load bushing segments 102, without resulting in excessive radial load on the tubular 106. Further, by employing a radially expandable load bushing 103, the load transfer sleeve 100 may be received over the box end of a vertically-oriented tubular 106, e.g., a pipe stand that is already racked back.

As noted above, the load transfer sleeve 100 may also be employed with the tubular 106 initially being in a horizontal or any other non-vertical orientation. In such case, the load transfer sleeve 100 may laterally receive the tubular 106, below the upset 134, for example, by pivoting the two arcuate body portions 110, 112 apart. In another case, the load transfer sleeve 100 may be received over the box end 136 of the tubular 106 in the non-vertical position, with the load bushing 103 being expanded as described above. The load bushing segments 102 may then be lowered (with respect to the bowl 120), such that the load bushing segments 102 land on the landing surface 128 and are thus positioned to engage the upset 134.

The load transfer sleeve 100 may be coupled with the spreader bar 302, which may be employed to move the load transfer sleeve 100 into engagement with the upset 134, and hoist the tubular 106 via the connection with the load transfer sleeve 100 to a vertical position. Once in the vertical position, deploying the tubular 106 may proceed substantially as described above for the tubular 106 starting from the vertical orientation.

Figure 10:
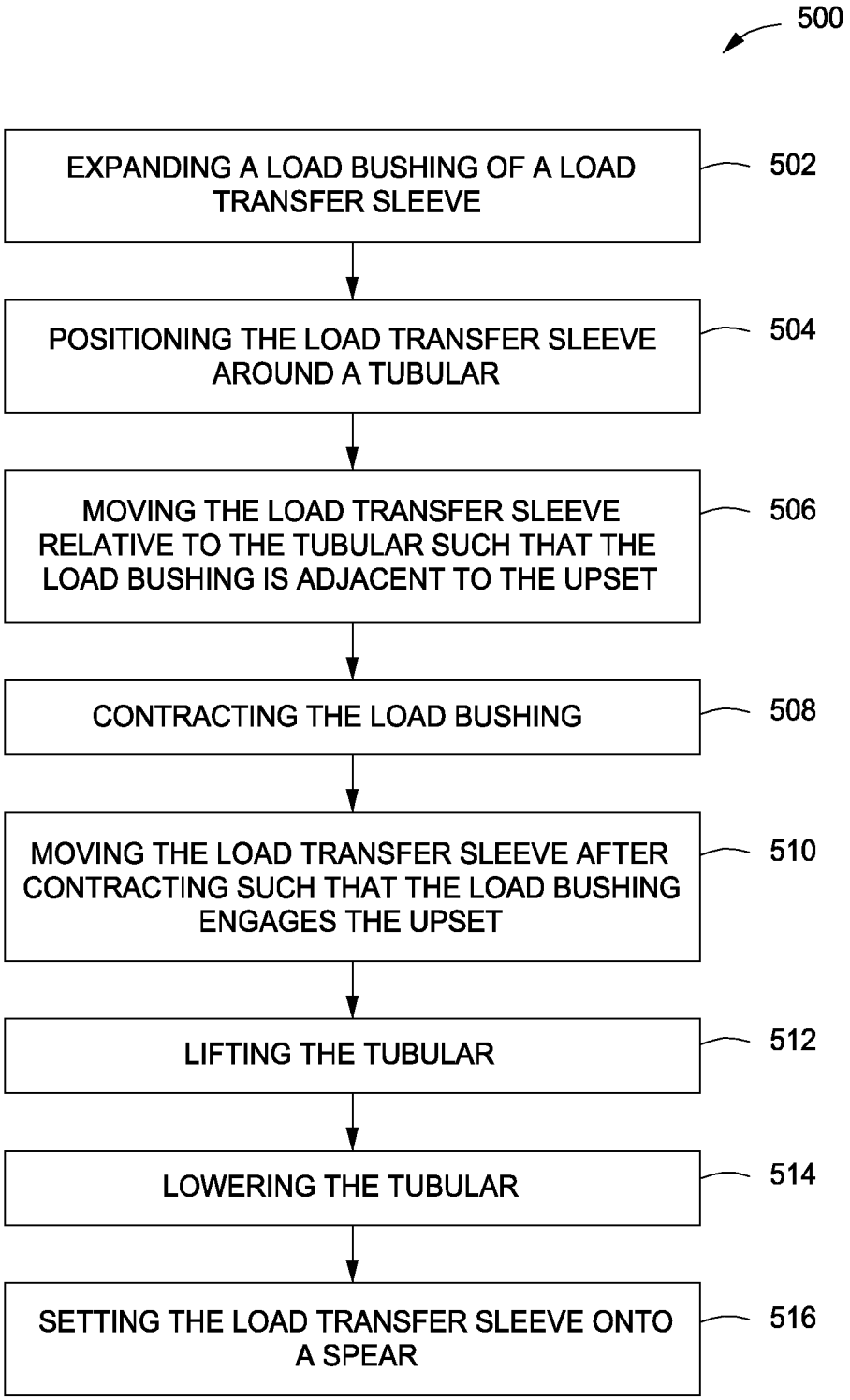
FIG. 10 illustrates a flowchart of a method for handling a tubular, according to an embodiment.

FIG. 10 illustrates a flowchart of a method 500 for handling a tubular, according to an embodiment. The method 500 may, in an embodiment, proceed by operation of one or more embodiments of the load transfer sleeve 100 discussed above and thus is described with reference thereto. However, it will be appreciated that the method 500 does not require any particular structure unless otherwise expressly stated herein.

At least when the tubular 106 begins in a vertical orientation, the method 500 may begin by expanding the load bushing 103 of the load transfer sleeve 100, as at 502. This may proceed, for example, by the setting plate 138 attached to bushing segments 102 of the load bushing 103 being driven axially away from the body 101. The load bushing segments 102 may slide along the tapered bowl 120, and thus such axial movement of the load bushing segments 102 may result in a proportional radial outward movement thereof. Such radial outward movement may result in the load bushing segments 102 being circumferentially separated, thereby expanding the load bushing 103. In non-vertical starting positions for the tubular 106, the load bushing 103 may or may not be initially expanded at 502.

The load transfer sleeve 100 may be positioned around the tubular 106, as at 504. For example, the tubular 106 may be in a vertical, "racked-back" orientation, and the load transfer sleeve 100 may be received over the top, box end of the tubular 106, e.g., with the load bushing 103 in an expanded configuration. In another example, the tubular 106 may initially be in a horizontal or another non-vertical position, and the load bushing 103 may laterally receive the tubular 106 by pivoting the two (or more) arcuate body portions 110, 112 apart and receiving the tubular 106 therebetween. In a third example, the load bushing 103 may be received over the box end of the tubular 106 while the tubular 106 is in the horizontal, or another, non-vertical position.

The load transfer sleeve 100 may be moved relative to the tubular 106, such that the load bushing 103 is moved to a position adjacent to an upset 134 of the tubular 106, as at 506. For example, the load transfer sleeve 100 may be moved by lowering the load transfer sleeve 100 using the spreader bar 302 and/or the elevator 300.

When the load transfer sleeve 100 is positioned where that radial movement of the load bushing segments 102 is not obstructed by the upset 134, whether before or after moving at 506, the load bushing 103 may be radially contracted, as at 508. For example, when the tubular 106 is initially in a vertical orientation, the load transfer sleeve 100 may be lowered over the box end 136 of the tubular 106, until the box end 136 does obstruct the movement of the load bushing segments 102. When the tubular 106 is in a horizontal or non-vertical starting position, the load transfer sleeve 100 may be positioned around the tubular 106, below the upset 134, and the load bushing segment 102 may be contracted at 508 either before or after moving at 506.

Such radial contraction at 508 may be effected by axially moving the bushing segments 102 by lowering the setting plate 138 toward the body 101. By this lowering, the load bushing segments 102 may slide along the tapered bowl 120, and thus proceed radially inwards and axially downwards with respect to the body 101. The load bushing segments 102 may land on the landing surface 128 of the bowl 120, and thereby be prevented from further axially downward or radially inward movement.

Further, the radial contraction may result in the inserts 104 of the load bushing segments 102 contacting the outer diameter of the tubular 106, but in other embodiments, no continuous contact around the outer diameter of the tubular 106, below the upset 134, may be made by the inserts 104. That is, in at least one embodiment, the inserts 104 may incidentally contact the outer diameter of the tubular 106, but all of the bushing segments 102 contacting the tubular 106 at once may be prevented, as the radius defined by the bushing segments 102 may be greater than the radius of the tubular 106. Moreover, the radial contraction of the load bushing 103 may result in the axial engagement surface 132 of the inserts 104 being aligned with the upset 134.

The load transfer sleeve 100 may then be moved upward (i.e., toward the upset 134) with respect to the tubular 106, such that the axial engagement surface 132 engages, e.g., abuts and bears on, the upset 134 of the tubular 106, as at 510. With the bushing segments 102 landed on the landing surface 128, axial force applied to the axial engagement surface 132 may be transferred to the body 101, without resulting in the bushing segments 102 moving axially downwards or radially inwards.

Using the load transfer sleeve 100 and the lifting components attached thereto (e.g., elevator 300, spreader bar 302, etc.), the tubular 106 may be lifted, e.g., hoisted from a horizontal orientation to a vertical orientation and/or supported in the vertical orientation, as at 512. The tubular 106 may then be moved into position above the previously-run tubular, and then lowered, as at 514. The tubular 106 may be made up to the previously run tubular, and then deployed into the wellbore 401 by continuing to lower the load transfer sleeve 100. During such deployment the spear 200 may be open, i.e., the arcuate portions 202, 204 may be pivoted apart, so as to allow for lateral play in the tubular 106 as it is lowered.

Eventually, the lowering may result in the load transfer sleeve 100 coming into proximity with the spear 200. Accordingly, the spear 200 may be closed (i.e., the arcuate portions 202, 204 being pivoted together) and the load transfer sleeve 100 may be set down on the spear 200, as at 516. The load transfer sleeve 100 may receive a portion of the spear 200, which may prevent lateral movement of the load transfer sleeve 100 with respect thereto. With the load transfer sleeve 100 supported by the spear 200, the lifting device (e.g., elevator 300) may be removed from engagement with the load transfer sleeve 100 and used to handle the next stand of tubular. Once the next stand of tubular is made up to the box end 136 of the tubular 106, so as to support the weight thereof, the load transfer sleeve 100 may be removed from the tubular 106, e.g., by pivoting the arcuate body portions 110, 112 apart using the hinge 114 and laterally moving the load transfer sleeve 100 away from the tubular 106.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for handling a tubular, comprising:

positioning a load transfer sleeve around the tubular;

contracting a radially-expandable load bushing of the load transfer sleeve, such that a plurality of load bushing segments of the radially-expandable load bushing abut a landing surface of a bowl defined in a body of the load transfer sleeve;

moving the radially-expandable load bushing relative to the tubular, after contracting the radially-expandable load bushing, until an upset of the tubular abuts an axial engagement surface of the radially-expandable load bushing; and lifting the tubular by lifting the load transfer sleeve.

2. The method of claim 1, further comprising:

lowering the tubular through a spear; and setting the load transfer sleeve onto the spear, such that the spear supports a weight of the tubular via the load transfer sleeve.

3. The method of claim 2, wherein setting the load transfer sleeve onto the spear comprises receiving a portion of the spear into a groove extending from an inner diameter of the body of the load transfer sleeve.

4. The method of claim 1, further comprising:

lowering the tubular through a landing structure or a shock table; and setting the load transfer sleeve onto the landing structure or shock table, such that the landing structure or the shock table supports a weight of the tubular via the load transfer sleeve.

5. The method of claim 4, wherein setting the load transfer sleeve onto the landing structure or shock table comprises receiving a feature of the load transfer sleeve using a feature of the landing structure or shock table so as to coaxially align the load transfer sleeve with the landing structure or shock table.

6. The method of claim 1, further comprising:

pivoting two arcuate portions of the body of the load transfer sleeve apart; and removing the load transfer sleeve from the tubular in a lateral direction.

7. The method of claim 1, wherein the radially-expandable load bushing radially expands and contracts by axial translation of the plurality of load bushing segments relative to the body.

8. A method for handling a tubular, comprising:

positioning a load transfer sleeve around the tubular;

expanding a radially-expandable load bushing of the load transfer sleeve prior to positioning the load transfer sleeve around the tubular, wherein positioning the load transfer sleeve around the tubular comprises receiving the load transfer sleeve over a box end of the tubular;

contracting the radially-expandable load bushing of the load transfer sleeve, such that a plurality of load bushing segments of the radially-expandable load bushing abut a landing surface of a bowl defined in a body of the load transfer sleeve;

moving the radially-expandable load bushing relative to the tubular, after contracting the radially-expandable load bushing, until an upset of the tubular abuts an axial engagement surface of the radially-expandable load bushing; and lifting the tubular by lifting the load transfer sleeve.

9. The method of claim 8, further comprising:

lowering the tubular through a spear; and setting the load transfer sleeve onto the spear, such that the spear supports a weight of the tubular via the load transfer sleeve.

10. The method of claim 9, wherein setting the load transfer sleeve onto the spear comprises receiving a portion of the spear into a groove extending from an inner diameter of the body of the load transfer sleeve.

11. The method of claim 8, further comprising:

lowering the tubular through a landing structure or a shock table; and setting the load transfer sleeve onto the landing structure or shock table, such that the landing structure or the shock table supports a weight of the tubular via the load transfer sleeve.

12. The method of claim 11, wherein setting the load transfer sleeve onto the landing structure or shock table comprises receiving a feature of the load transfer sleeve using a feature of the landing structure or shock table so as to coaxially align the load transfer sleeve with the landing structure or shock table.

13. The method of claim 8, wherein the radially-expandable load bushing radially expands and contracts by axial translation of the plurality of load bushing segments relative to the body.

14. A method for handling a tubular, comprising:

positioning a load transfer sleeve around the tubular, wherein positioning the load transfer sleeve around the tubular comprises:

pivoting two arcuate portions of the body of the load transfer sleeve apart; and receiving the tubular between the two arcuate portions;

contracting a radially-expandable load bushing of the load transfer sleeve, such that a plurality of load bushing segments of the radially-expandable load bushing abut a landing surface of a bowl defined in a body of the load transfer sleeve;

moving the radially-expandable load bushing relative to the tubular, after contracting the radially-expandable load bushing, until an upset of the tubular abuts an axial engagement surface of the radially-expandable load bushing; and lifting the tubular by lifting the load transfer sleeve.

15. The method of claim 14, further comprising:

lowering the tubular through a spear; and setting the load transfer sleeve onto the spear, such that the spear supports a weight of the tubular via the load transfer sleeve.

16. The method of claim 15, wherein setting the load transfer sleeve onto the spear comprises receiving a portion of the spear into a groove extending from an inner diameter of the body of the load transfer sleeve.

17. The method of claim 14, further comprising:

lowering the tubular through a landing structure or a shock table; and setting the load transfer sleeve onto the landing structure or shock table, such that the landing structure or the shock table supports a weight of the tubular via the load transfer sleeve.

18. The method of claim 17, wherein setting the load transfer sleeve onto the landing structure or shock table comprises receiving a feature of the load transfer sleeve using a feature of the landing structure or shock table so as to coaxially align the load transfer sleeve with the landing structure or shock table.

19. The method of claim 14, further comprising:

pivoting the two arcuate portions of the body of the load transfer sleeve apart after the tubular is lifted; and removing the load transfer sleeve from the tubular in a lateral direction after the tubular is lifted.

20. The method of claim 14, wherein the radially-expandable load bushing radially expands and contracts by axial translation of the plurality of load bushing segments relative to the body.

* * * * *